US009514674B2

(12) United States Patent
Kumeta et al.

(10) Patent No.: US 9,514,674 B2
(45) Date of Patent: Dec. 6, 2016

(54) DISPLAY APPARATUS WITH INITIALIZATION CONTROL AND DRIVING METHOD OF DISPLAY APPARATUS

(71) Applicant: SAMSUNG DISPLAY CO., LTD., Yongin, Gyeonggi-Do (KR)

(72) Inventors: Masayuki Kumeta, Yokohama (JP); Takeshi Okuno, Yokohama (JP); Eiji Kanda, Yokohama (JP); Ryo Ishii, Yokohama (JP); Naoaki Komiya, Yokohama (JP)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 283 days.

(21) Appl. No.: 14/254,169

(22) Filed: Apr. 16, 2014

(65) Prior Publication Data

US 2014/0320549 A1 Oct. 30, 2014

(30) Foreign Application Priority Data

Apr. 25, 2013 (JP) ..... 2013-092090

(51) Int. Cl.
*G09G 3/32* (2016.01)

(52) U.S. Cl.
CPC .... *G09G 3/3225* (2013.01); *G09G 2300/0847* (2013.01); *G09G 2310/0297* (2013.01); *G09G 2320/045* (2013.01)

(58) Field of Classification Search
CPC ..... G09G 2300/0847; G09G 2310/0297; G09G 2320/045; G09G 3/3225
See application file for complete search history.

(56) References Cited

U.S. PATENT DOCUMENTS

2005/0105031 A1* 5/2005 Shih ..... G09G 3/3233 349/139
2005/0156829 A1 7/2005 Choi et al.
2007/0164959 A1 7/2007 Childs
2009/0046041 A1* 2/2009 Tanikame ..... G09G 3/3233 345/76
2009/0225011 A1* 9/2009 Choi ..... G09G 3/3233 345/77
2011/0074757 A1* 3/2011 Chung ..... G09G 3/3233 345/211
2011/0102403 A1* 5/2011 Kim ..... G09G 3/3233 345/211
2011/0298836 A1* 12/2011 Komiya ..... G09G 3/3233 345/690
2012/0038607 A1* 2/2012 Kang ..... G09G 3/325 345/211
2012/0139890 A1* 6/2012 Choi ..... G09G 3/3233 345/212
2012/0162275 A1* 6/2012 Park ..... H01L 27/3262 345/690

FOREIGN PATENT DOCUMENTS

JP 2004-341144 A 12/2004
JP 2005-520191 A 7/2005
JP 2007-519956 A 7/2007
JP 2008-122748 A 5/2008
JP 2011-022434 A 2/2011

* cited by examiner

*Primary Examiner* — Priyank Shah
*Assistant Examiner* — Elliott Deaderick
(74) *Attorney, Agent, or Firm* — Lee & Morse, P.C.

(57) ABSTRACT

A display device includes a driving transistor in a pixel circuit. A signal line is connected to a source or drain of the driving transistor. The source or drain of the driving transistor receives a power source voltage, an initialization voltage, and a data voltage through the signal line during different periods of operation. The periods of operation include an emission and non-emission periods.

20 Claims, 14 Drawing Sheets

(a) Initialization
(b) Data program + Vth compensation
(c) Light emitting (a) Initialization
(b) Data program + Vth compensation
(c) Light emitting (a) Initialization
(b) Data program + Vth compensation
(c) Light emitting (a) Initialization
(b) Data program + Vth compensation
(c) Light emitting (a) Initialization
(b-1) Vth compensation
(b-2) Data program
(c) Light emitting

DISPLAY APPARATUS WITH INITIALIZATION CONTROL AND DRIVING METHOD OF DISPLAY APPARATUS

CROSS-REFERENCE TO RELATED APPLICATION

Japanese Application No. 2013-092090, filed Apr. 25, 2013, and entitled "Display Apparatus and Driving Method of Display Apparatus," is incorporated by reference herein in its entirety.

BACKGROUND

1. Field

One or more embodiments described herein relate to a display device.

2. Description of the Related Art

Various types of flat panel displays have been developed. One type, known as an organic light emitting display, has pixels with light emitting diodes (e.g., organic electroluminescence (EL) elements) that emit light based on intensities of supplied current. The amount of current to be supplied to each diode is adjusted by a driving transistor. This adjustment produces the gray scale value of light to be emitted. If the operating characteristics (e.g., threshold voltage) of the driving transistor vary, gray scale expression may be adversely affected.

Techniques have been developed in an attempt to suppress this threshold voltage variation. However, these and other proposed techniques increase the number of transistors in each pixel circuit or otherwise complicate control of light emission. As a result, it is difficult to reduce the scale of the pixel circuits.

SUMMARY

In accordance with one embodiment, a display apparatus includes a first P-type transistor configured to control an amount of current of a light emitting diode, one of source or drain terminals of the first P-type transistor being connected to an anode of the light emitting diode; a first control line connected to the other of the source or drain terminals of the first P-type transistor, the first control line to supply a gray scale data voltage to set a gate voltage of the first P-type transistor, an initialization voltage to initialize a gate voltage of the first P-type transistor, and an anode voltage for light emission of the light emitting diode; a second P-type transistor configured to selectively connect the one terminal of the first P-type transistor and a gate terminal of the first P-type transistor; a second control line to supply different levels of voltages; and a capacitive element having a first electrode connected to the gate terminal of the first P-type transistor and a second electrode connected to the second control line.

The display apparatus may include a control circuit to set the light emitting diode to a non-light emitting state by controlling the cathode voltage of the light emitting diode during a non-light emitting period of the light emitting diode, the non-light emitting period including an initialization period of the gate voltage and a data program period following the initialization period, supply the initialization voltage to the first control line and supply a second voltage higher than a first voltage to the second control line after the first voltage is supplied to the second control line during the initialization period, the control circuit turning the P-type second transistor on, supply the gray scale voltage to the first control line and turn the second P-type transistor on when a gate voltage of the first P-type transistor is set to the gray scale voltage during the program period, and turn off the second transistor, control the cathode voltage of the light emitting diode to set the light emitting diode to a light emitting state and control an operation of supplying the anode voltage to the first control line during a light emitting period of the light emitting diode.

A compensation voltage between the initialization voltage and the gray scale data voltage may be supplied to the first control line during a compensation period between the initialization period and the data program period, and the control circuit may turn the second P-type transistor on and may supply the compensation voltage to the first control line.

In accordance with another embodiment, a display apparatus includes a first N-type transistor configured to control an amount of current of a light emitting diode, one of source or drain terminals of the first N-type transistor being connected to a cathode of the light emitting diode; a first control line connected to the other of the source or drain terminals of the first N-type transistor and to supply a gray scale data voltage to set a gate voltage of the first N-type transistor, an initialization voltage to initialize a gate voltage of the first N-type transistor, and a cathode voltage for light emission of the light emitting diode; a second N-type transistor configured to selectively connect the one terminal of the first N-type transistor and a gate terminal of the first N-type transistor; a second control line to supply two levels of voltages; and a capacitive element having a first electrode connected to the gate terminal of the first N-type transistor and a second electrode connected to the second control line.

The display apparatus may include a control circuit to control the light emitting diode to a non-light emitting state by controlling an anode voltage of the light emitting diode during a non-light emitting period of the light emitting diode, the non-light emitting period including an initialization period of the gate voltage and a data program period following the initialization period, turn the second N-type transistor on, supply the initialization voltage to the first control line, and supply a second voltage higher than a first voltage to the second control line after the first voltage is supplied to the second control line during the initialization period, supply the gray scale voltage to the first control line and turn the second transistor on when a gate voltage of the first N-type transistor is set to the gray scale voltage during the program period, and turn the second N-type transistor off, control the anode voltage of the light emitting diode to set the light emitting diode to a light emitting state, and control an operation of supplying the cathode voltage to the first control line during a light emitting period of the light emitting diode.

A compensation voltage between the initialization voltage and the gray scale data voltage may be supplied to the first control line, and the control circuit may turn the second N-type transistor on and supply the compensation voltage to the first control line during a compensation period between the initialization period and the data program period.

In accordance with another embodiment, a method of driving a display apparatus includes setting a light emitting diode to a non-light emitting state by controlling a cathode voltage of the light emitting diode during a non-light emitting period, the non-light emitting period including an initialization period of a gate voltage of a first transistor and a data program period following the initialization period; turning on a second P-type transistor during the initialization period, supplying an initialization voltage to a first control line and a second voltage higher than a first voltage a second control line after the first voltage is supplied to the second control line; supplying a gray scale voltage to the first control line and turning on the second transistor on when a gate voltage of the first transistor is set to the gray scale voltage during the data program period; and turning off the second transistor and controlling the cathode voltage of the light emitting diode to set the light emitting diode a light emitting state, and supplying the anode voltage to the first control line during a light emitting period.

The method may include supplying a compensation voltage to the first control line, the compensation voltage being between the initialization and gray scale data voltage, and turning on the second transistor and supplying the compensation voltage to the first control line during a compensation period between the initialization period and the data program period.

In accordance with another embodiment, a method of driving a display apparatus includes setting a light emitting diode to a non-light emitting state by controlling the anode voltage of the light emitting diode during a non-light emitting period, the non-light emitting period including an initialization period of a gate voltage of a first transistor and a data program period following the initialization period; turning on a second transistor, supplying an initialization voltage to a first control line, and supplying a second voltage higher than a first voltage to a second control line after the first voltage is supplied to the second control line during the initialization period; supplying a gray scale voltage to the first control line and turning on the second transistor when a gate voltage of the first transistor is set to the gray scale voltage during the data program period; and turning off the second transistor, controlling the anode voltage of the light emitting diode to set the light emitting diode to a light emitting state, and supplying the cathode voltage to the first control line during a light emitting period.

The method may include supplying a compensation voltage to the first control line, the compensation voltage being between the initialization and gray scale data voltages, and turning on the second transistor and supplying the compensation voltage to the first control line during a compensation period between the initialization period and the data program period.

In accordance with another embodiment, an apparatus includes a pixel circuit; a driving transistor in the pixel circuit; and a signal line connected to a source or drain of the driving transistor, wherein the source or drain of the driving transistor receives a power source voltage, an initialization voltage, and a data voltage through the signal line during different periods of operation. The initialization voltage and data voltage may be received through the signal line during a non-light-emission period, and the power source voltage may be received during a light-emission period.

The apparatus may include a switching transistor coupled to a gate of the driving transistor, wherein the switching transistor is to place the driving transistor in a diode-connected state during a non-light-emission period based on a scan signal. The driving transistor and switching transistor may be the only transistors in the pixel circuit.

The apparatus may include a capacitor connected to the gate of the driving transistor, wherein the switching transistor is connected to the gate of the driving transistor at a location between the gate of the driving transistor and the capacitor. The capacitor may receive the data voltage along a data path which passes through the driving transistor and the switching transistor.

The source or drain of the driving transistor may receive a compensation voltage through the signal line during a compensation period. The compensation voltage may be between the power source voltage and the initialization voltage. The compensation voltage may be less than the data voltage. The compensation period may be between an initialization period and a data program period of non-light-emission period.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
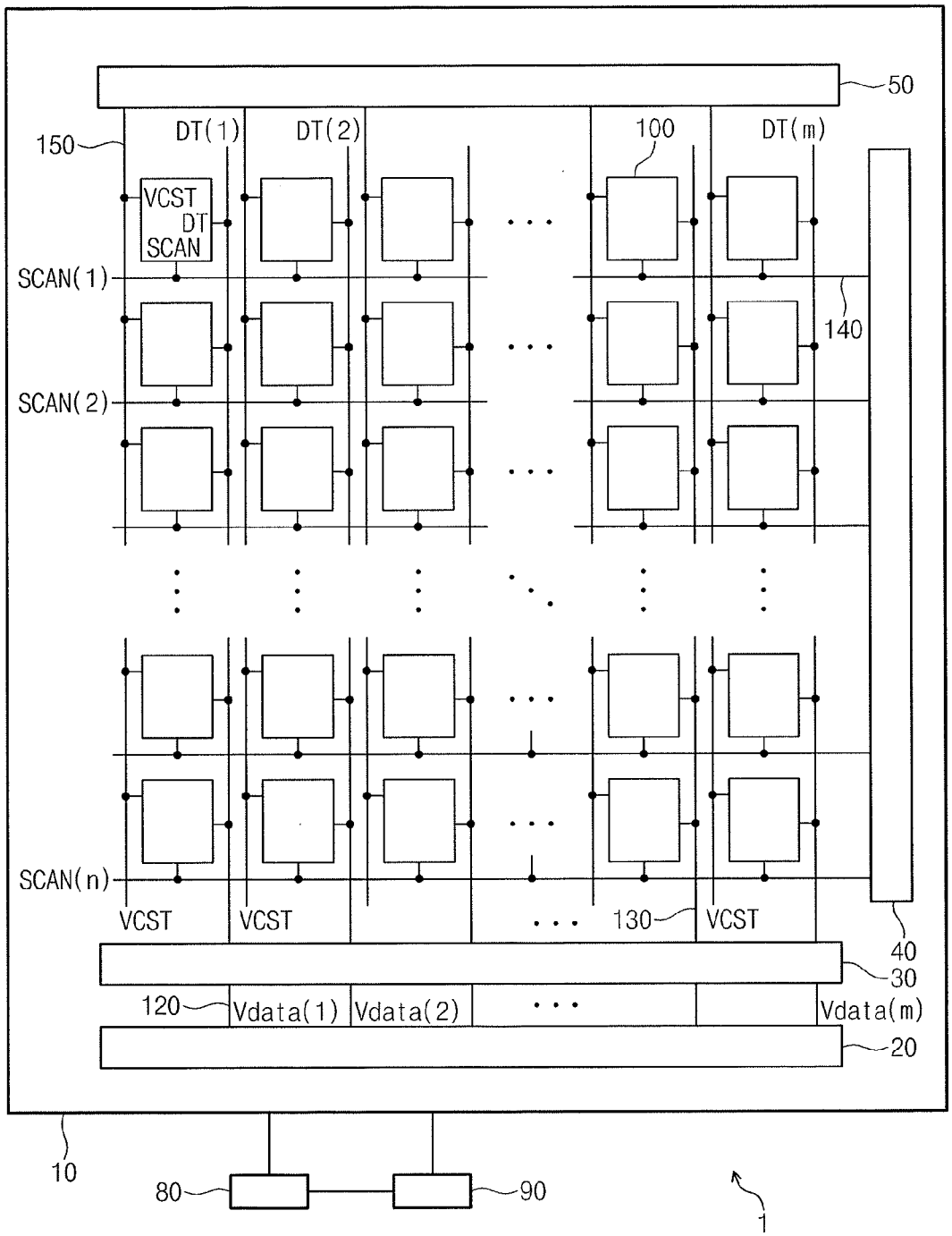
FIG. 1 illustrates an embodiment of an electronic apparatus.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

First Embodiment

FIG. 1 illustrates an embodiment of an electronic apparatus 1 which may be, or may be included in, a smart phone, a handheld telephone, a personal computer, a television, or another type of electronic apparatus.

Referring to FIG. 1, the electronic apparatus 1 includes a display apparatus 10, a control unit 80, and a power supply 90. The display apparatus 10 includes a plurality of pixel circuits 100 in a matrix shape. Each pixel circuit 100 may be defined as a pixel.

Each pixel circuit 100 may include at least one light emitting diode. When the light emitting diodes of the pixels emit light, an image is displayed. Each pixel circuit 100 may include a light emitting diode EL as illustrated, for example, in FIG. 3. In exemplary embodiments, the light emitting diode EL may be a light emitting element that uses an OLED (Organic Light Emitting Diode). The light emitting diode EL may have a capacitive component Cel as parasitic capacitance. For illustrative purposes, the pixel circuits 100 in FIG. 1 are arranged in a n×m matrix. In other embodiments, the pixel circuits may be in a different arrangement.

The control unit 80 may include a central processing unit (CPU) and a memory. The control unit 80 may be a controller, microprocessor, computer, or other processing device which controls operation of the display apparatus 10. More particularly, the control unit 80 controls a data line driving circuit 20, a switch circuit 30, a scan line driving circuit 40, and a capacitance line driving circuit 50.

The control unit 80 receives image data and determines gray scale values to be displayed from pixel circuits 100 based on the image data. The control unit 80 provides data voltages (e.g., gray scale data voltages) according to the determined gray scale values provided to pixel circuits 100, to thereby cause light emitting diodes ELs of the pixel circuits 100 to emit light.

The power supply 90 powers display apparatus 10 and control unit 80. In the display apparatus 10, current flowing from an anode of light emitting diode EL of each pixel circuit 100 to its cathode is supplied from power supply 90. For example, an anode voltage ELVDD and a cathode voltage ELVSS are supplied from power supply 90 for each pixel circuit 100. A voltage level of the cathode voltage ELVSS may be changed according to control of the control unit 80.

The display apparatus 10 includes pixel circuits 100, data line driving circuit 20, switch circuit 30, scan line driving circuit 40, and capacitance line driving circuit 50. The data line driving circuit 20, switch circuit 30, scan line driving circuit 40, and capacitance line driving circuit 50 may be driving circuits for driving pixel circuits 100.

During a data program period (FIGS. 4 and 5), the scan line driving circuit 40 selects a row of pixel circuits 100 by providing a scan signal SCAN to scan lines 140 corresponding to pixel circuits 100 in each row. The pixel circuits 100 in each row write a data voltage in response to the scan signal SCAN.

In one embodiment, first to nth rows are sequentially and exclusively selected in order. A scan signal SCAN(p) may be a signal supplied to a pth row (p=1, 2, 3 . . . n).

The scan signal SCAN corresponding to a selected row of pixel circuits 100 may have a low level. The scan signal SCAN corresponding to an unselected row of pixel circuits 100 may have a high level. In one embodiment, during the remaining period(s) other than the data program period, a scan signal SCAN of each row may be controlled to be identically set to a high level or a low level.

The capacitance line driving circuit 50 provides a capacitance control signal VCST to a capacitance control line 150, corresponding to a respective column of pixel circuits 100. The capacitance control signal VCST may be a signal which is switched between two levels of voltages: a high level and a low level. The capacitance control signal VCST is provided in common to the pixel circuits 100. In one embodiment, the capacitance control line 150 may correspond to each column of pixel circuits 100. In other embodiments, the capacitance control line 150 may correspond to each row of pixel circuits 100.

The data line driving circuit 20 provides a gray scale data voltage Vdata to a data output line 120, corresponding to each column of pixel circuits 100. Vdata(q) may be a gray scale data voltage to be written in pixel circuits 100 in a qth column (q=1, 2, 3 . . . m). The gray scale data voltage Vdata may be a gray scale data voltage corresponding to pixel circuits 100 in a row selected by the scan signal SCAN. The gray scale data voltage may be written in target pixel circuits 100.

Figure 2:
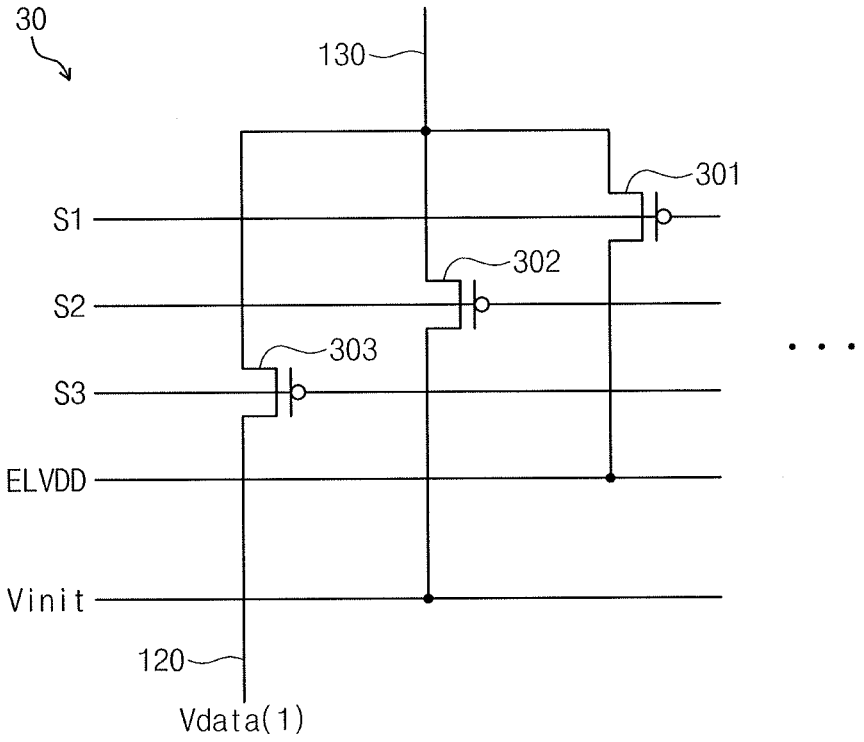
FIG. 2 illustrates a first embodiment of a switch circuit.

The switch circuit 30 is provided with gray scale data voltage Vdata and a plurality of voltages (shown, for example, in FIG. 2). The switch circuit 30 selects one of the input voltages for output to a data control line 130. A voltage signal output to the data control line 130 may be defined as a data control signal DT. A data control signal DT(p) may be a signal to be supplied to a pth row (p=1, 2, 3 . . . n).

FIG. 2 illustrates an embodiment of switch circuit 30, which is connected to data control lines 130 corresponding to a first column. Referring to FIG. 2, switch circuit 30 receives a gray scale data voltage Vdata, an anode voltage ELVDD, and an initialization voltage Vinit. The switch circuit 30 outputs one of the received gray scale data voltage Vdata, anode voltage ELVDD, or initialization voltage Vinit to data control line 130.

The switch circuit 30 includes transistors 301, 302, and 303. As the transistors 301, 302, and 303 are respectively turned on or off by corresponding control signals S1, S2, and S3, a voltage to be output to the data control line 130 is switched (or, selected). In one embodiment, the transistors 301, 302, and 303 may be p-type TFTs. In other embodiments, these transistors may be n-type TFTs.

Figure 3:
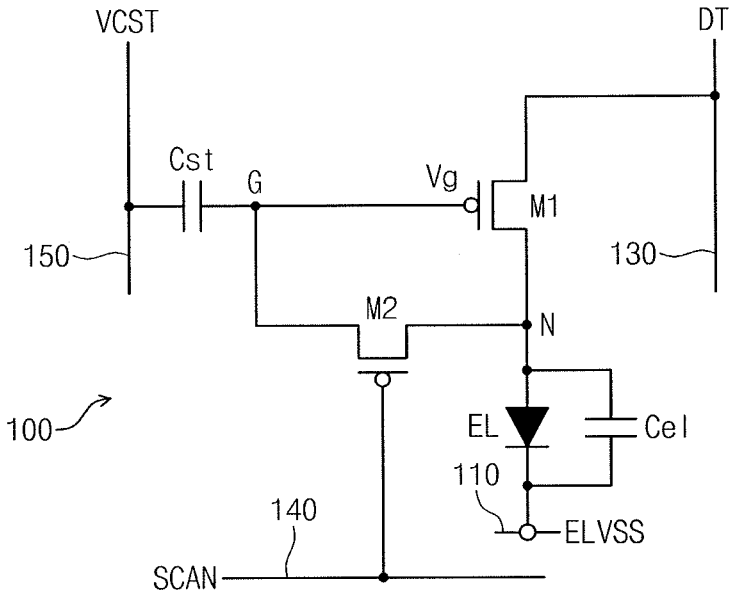
FIG. 3 illustrates a first embodiment of a pixel circuit.

FIG. 3 illustrating an embodiment of a pixel circuit 100 which includes two transistors M1 and M2, a capacitive element Cst, parasitic capacitance Cel, and a light emitting diode EL as a light emitting element. A cathode of the light emitting diode EL is connected to a cathode power 110 to receive a cathode voltage ELVSS.

One of source or drain terminals of transistor M1 is connected to an anode of the light emitting diode EL. The other of the source or drain terminals is connected to a data control line 130. One electrode of the capacitive element Cst is connected to a gate terminal of the transistor M1. The other electrode is connected to a capacitance control line 150.

A portion where the gate terminal of the transistor M1 is connected to the capacitive element Cst may be defined as a node G. A portion where the transistor M1 and the light emitting diode EL are connected may be defined as a node N. A voltage (e.g., a voltage of the node G) applied to the gate terminal of the transistor M1 may be defined as a gate voltage Vg.

One of source or drain terminals of transistor M2 is connected to the node G. The other of the source or drain terminals is connected to node N1. A gate terminal of the transistor M2 is connected to a scan line 140. When the transistor M2 is turned on, nodes N and G are connected and, as a result, transistor M1 becomes diode-connected.

Figure 4:
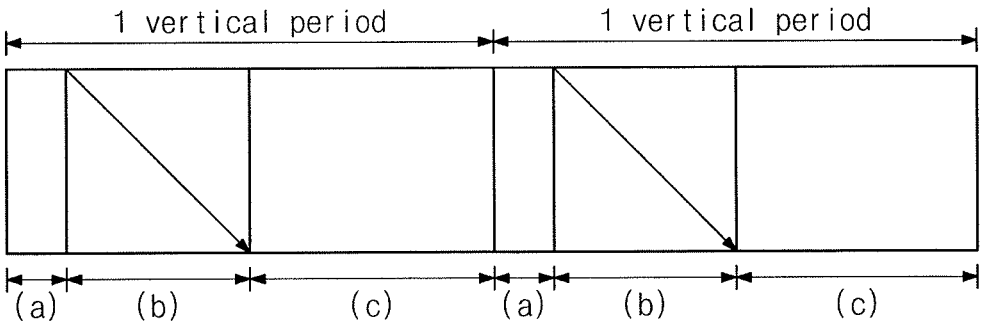
FIG. 4 illustrates a first embodiment of a method for driving a pixel circuit.

FIG. 4 illustrates an embodiment of a method for driving pixel circuit 100. The method is based on 1 vertical period that includes an initialization period, a data program period (including threshold voltage compensation), and a light emitting period. A light emitting diode EL does not emit a light during the initialization and data program periods. Thus, initialization and data program periods may be defined as a non-light emitting period. Also, in FIGS. 4 and 5, the data program period is marked as "data program+Vth compensation". However, in the first embodiment, the term "data program period" may be used instead of the "data program+Vth compensation".

In the initialization period, a gate voltage Vg of the driving transistors of each pixel circuit is initialized.

In the data program period, a gray scale data voltage Vdata is set to a gate voltage Vg of each pixel circuit 100. Data write timing is marked by an oblique line and shows, in a time-series manner, rows of pixel circuits 100 selected from a first row to an nth row according to a predetermined order in response to a scan signal SCAN. In that timing, a gray scale data voltage Vdata is set to nodes G of pixel circuits 100 in each row. With this driving method, the intensities of light emission of the light emitting diode ELs are set according to image data.

In the light emitting period, each light emitting diode EL emits light with an intensity that corresponds to the gray scale data voltage Vdata set to a corresponding pixel circuit 100.

Figure 5:
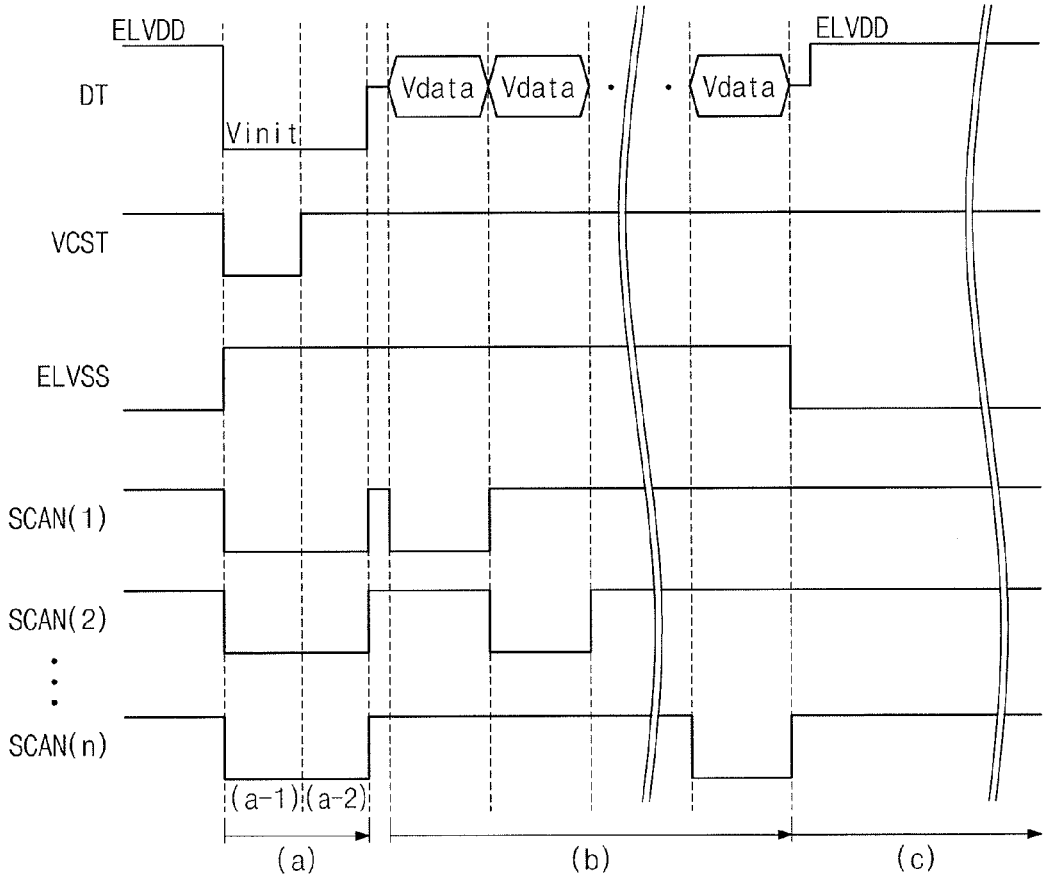
FIG. 5 illustrates a first embodiment of a timing diagram for the method.

FIG. 5 is a timing diagram for controlling pixel circuit 100 in accordance with the first method embodiment. Referring to FIG. 5, data control signal DT may have one of three voltages, namely an anode voltage ELVDD, an initialization voltage Vinit, and a gray scale data voltage Vdata. The voltage of the data control signal DT is selected by switch circuit 30. Other signals VCST, ELVSS, and SCAN may be changed between high and low levels at different times or periods The high and low voltage levels of each signal may be equal to or different from those of the other signals. In one embodiment, these levels are included in a range to support operation in a manner to be described in greater detail below. When p-type transistors are used, source-drain channels of the transistors do not conduct (or, is turned off) when a high level is provided to a gate terminal of the transistors and conducts (or, is turned on) when a low level is provided to these gate terminals.

In other embodiments, voltage levels of signals of the timing diagram may be different from those in FIG. 5. For example, the timing of a voltage level of a signal may be varied relative to the timing when voltage levels of one or more other signals, such that the timings that are illustrated to be simultaneous in FIG. 5 may not be simultaneous. Also, the timings of voltage level transitions in FIG. 5 may be faster or slower in other embodiments.

FIGS. 6 to 9 illustrate driving states of pixel circuits 100 according to a first embodiment. Here, periods (a-1), (a-2), (b), and (c) are respectively illustrated.

Figure 6:
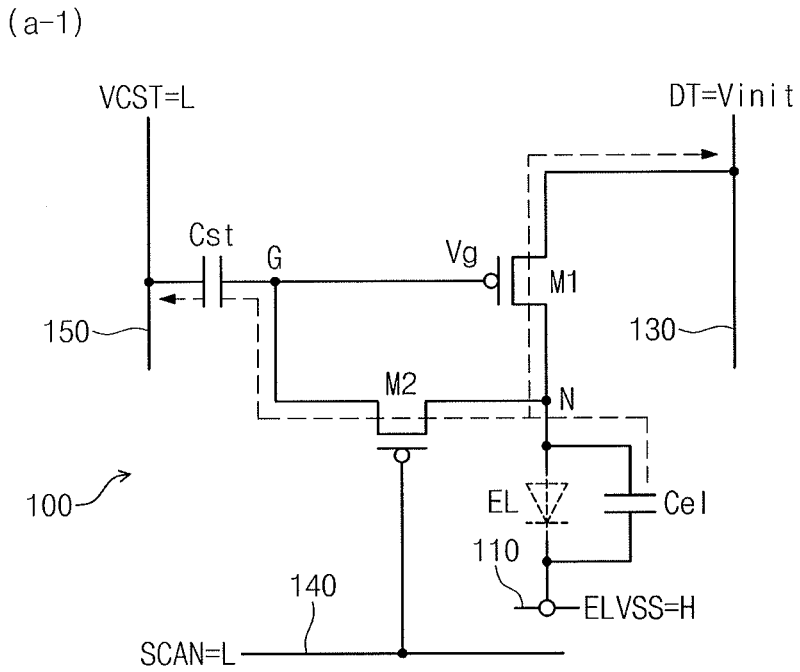
FIGS. 6-9 illustrate a first embodiment of driving states of pixel circuits.

Referring to FIG. 6, when a low level of scan signal SCAN is applied to all scan lines 140 in an initialization period (a-1), transistor M2 is turned on. Also, initialization voltage Vinit is applied to all data control lines 130 as data control signal DT.

Cathode power 110 may transition to a high level. A reverse bias state is set by making a cathode voltage ELVSS of a light emitting diode EL close to an anode voltage ELVDD, or by making the cathode voltage ELVSS higher than the anode voltage ELVDD. At this time, because a voltage between the anode and cathode is lower than a threshold value of light emission, pixel circuit 100 is set to a non-light emitting state.

Also, capacitance control signal VCST is switched from a high level to a low level. At this time, a gate voltage Vg is lowered by capacitive coupling of a capacitive element Cst, and transistor M1 is turned on in a linear region. Thus, charges stored in parasitic capacitance Cel and capacitive element Cst are transferred to a data control line 130 and are discharged. In this case, because the gate voltage Vg becomes (Vint−|Vth|), the transistor M1 is turned off. Vth indicates a threshold voltage of transistor M1.

Figure 7:
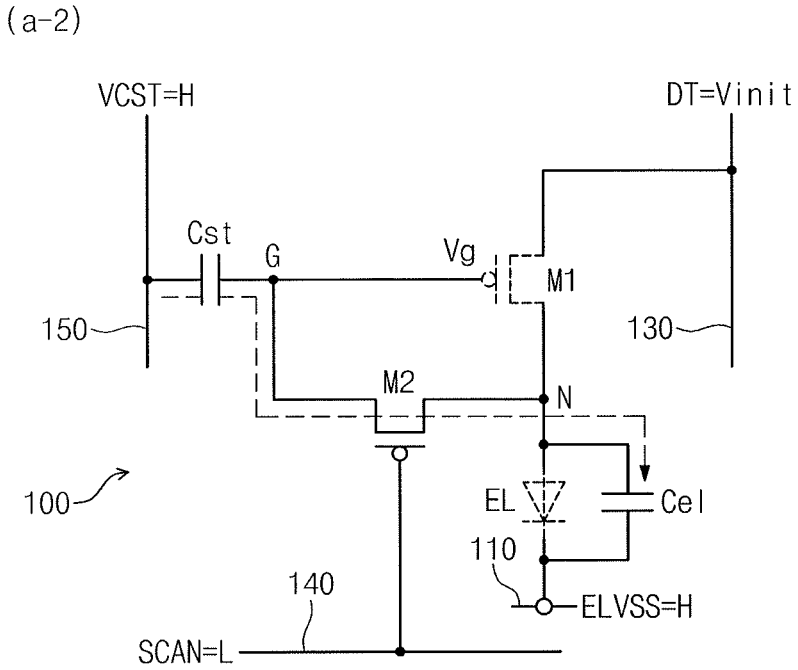

Referring to FIG. 7, during initialization period (a-2), the capacitance control signal VCST is switched from a low level to a high level. At this time, the gate voltage Vg increases by capacitive coupling of the capacitive element Cst, and a voltage of a node N of the parasitic capacitance Cel decreases. For this reason, an increase in the gate voltage Vg by capacitive coupling between the capacitive element Cst and the parasitic capacitance Cel is less than a decrease in the gate voltage Vg generated during the initialization period (a-1). The gate voltage Vg is initialized to a predetermined voltage through the above-descried operations.

The predetermined voltage is a voltage lower than (the lowest voltage of a gray scale data voltage−|Vth|). The pixel circuit 100 is initialized, and transistor M1 is set to be turned on when gray scale data voltage Vdata as a data control signal DT is selected.

Figure 8:
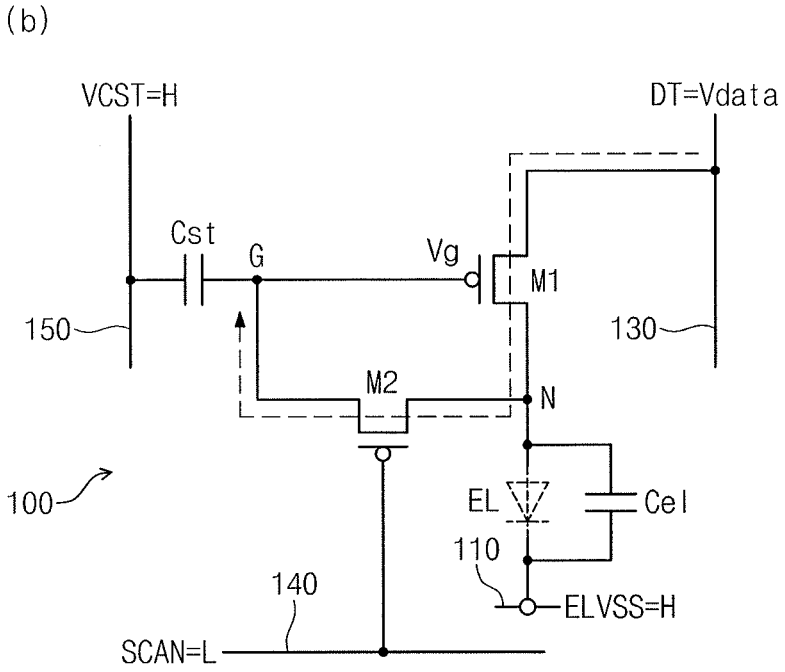

Referring to FIG. 8, during data program period (b), data control signal DT has gray scale data voltage Vdata. During a period where the gray scale data voltage Vdata is written, a scan signal SCAN corresponding to a row of pixel circuits 100 goes to a low level. At this time, transistors M1 and M2 are turned on together, and gate voltage Vg is set (or, data-programmed) to (Vdata−|Vth|).

Figure 9:
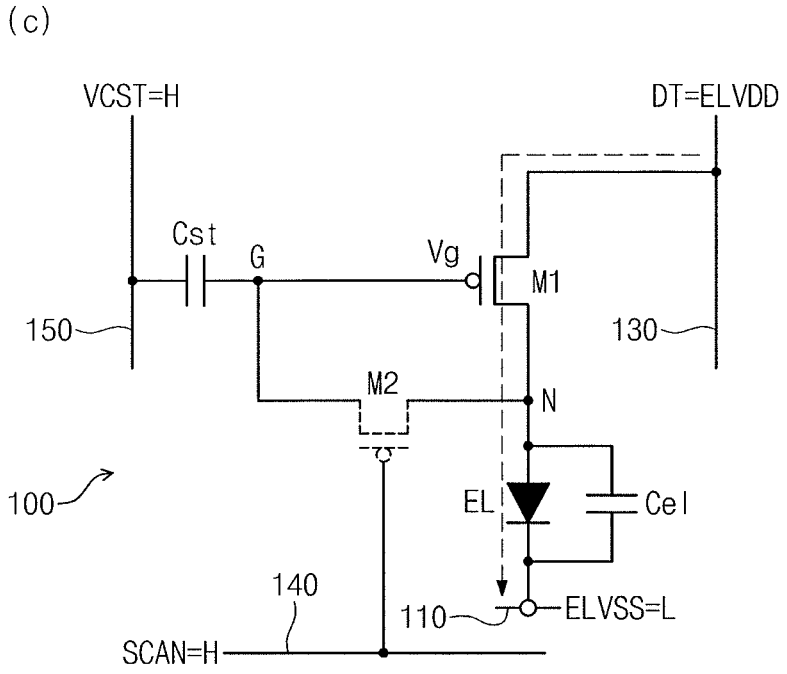

Referring to FIG. 9, as the scan signal SCAN goes to a high level during light emitting period (c), the transistor M2 is turned off. Also, as a cathode power 110 is set to a low level, the light emitting diode EL enters a light emission state and data control signal DT is switched to the anode voltage ELVDD.

With this bias condition, light emitting diode EL emits a light as current is supplied to the light emitting diode EL. The intensity of light emission is based on the amount of current flowing via the transistor M1 operating at a saturation region, and the amount of current is based on the gate voltage Vg of transistor M1. The gate voltage Vg is based on a threshold voltage Vth during data program period (b). For this reason, although a Vth difference occurs between pixel circuits 100, it may reduce influence which a current flowing via the transistor M1 suffers from.

Thus, a display apparatus according to a first embodiment performs Vth compensation while at the same time reducing the number of transistors per pixel. Thus, a greater layout freedom (e.g., high minuteness, improvement of opening ratio, and the like) may be achieved. Also, because this embodiment uses fewer transistors, product yield may be improved in terms of fabrication.

Also, because a relationship between the anode voltage ELVDD and cathode voltage ELVSS is set such that the light emitting diode EL does not emit a light during the non-light emitting period of the initialization period and the data program period, deterioration of the image quality due to black float is suppressed, and improved high definition may be realized.

Second Embodiment

Figure 10:
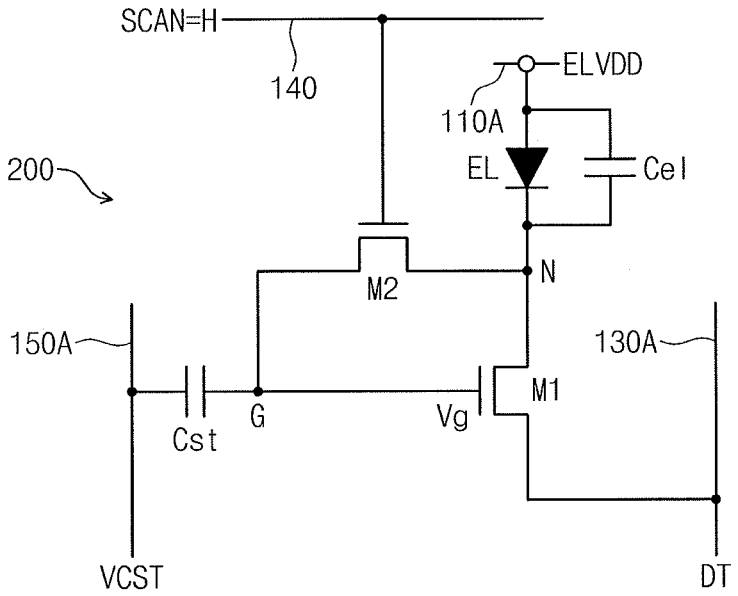
FIG. 10 illustrates a second embodiment of a pixel circuit.

FIG. 10 illustrates a second embodiment of a pixel circuit 200 which uses n-type transistors. The n-type transistor may be formed, for example, of an amorphous silicon TFT, an oxide semiconductor TFT, etc. In FIG. 10, because the transistors of pixel circuit 200 are n-type transistors, a cathode of a light emitting diode EL is connected to a node N and an anode of EL is connected to an anode electrode 110A.

Figure 11:
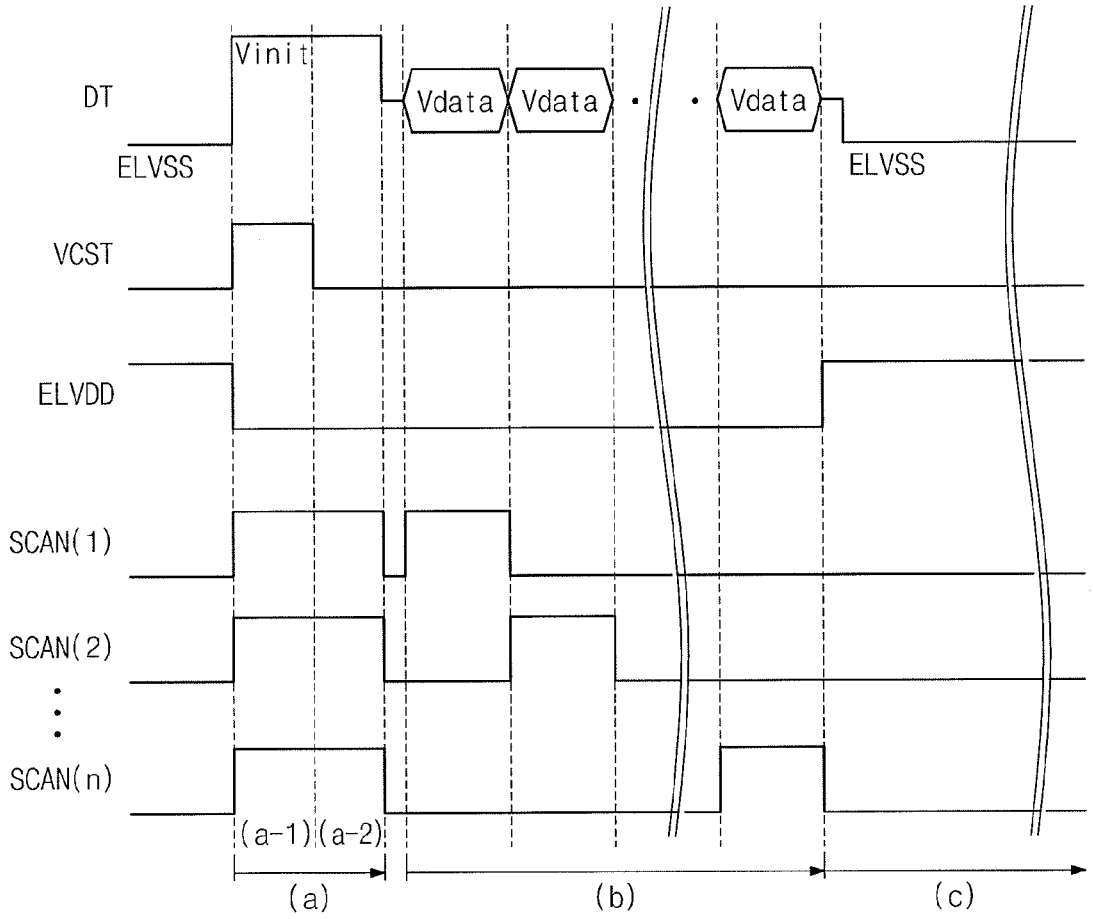
FIG. 11 illustrates a timing diagram corresponding to a second embodiment of a method for operating a pixel circuit.

FIG. 11 is a timing diagram illustrates signals for driving pixel circuit 200. Because pixel circuit 200 uses n-type transistors (which turn on in response to a high-level signal and turn off in response to a low-level signal), a relationship between a high and low levels and a voltage levels of data control signal DT are different from those in the timing diagram of the first embodiment, which uses p-type transistors.

In the second embodiment, cathode voltage ELVSS is provided to a switch circuit 30 and is output as a data control signal DT. Also, as an anode voltage ELVDD is switched from a high level to a low level, controlling non-light emitting and light emitting states of pixel circuit 200 is different from the first embodiment. Also, pixel circuits 200 may operate the same as the first embodiment, except for differences in p-type and n-type transistor operation. That is, although n-type transistor are used in pixel circuit 200, pixel circuit 200 may achieve the same effect as the first embodiment.

Third Embodiment

In a third embodiment, a Vth compensation period is provided between the initialization and data program periods. That is, according to the first embodiment, Vth compensation and data program are performed in the same period. However, in the third embodiment, a Vth compensation period is additionally provided to form a longer Vth compensation period.

Figure 12:
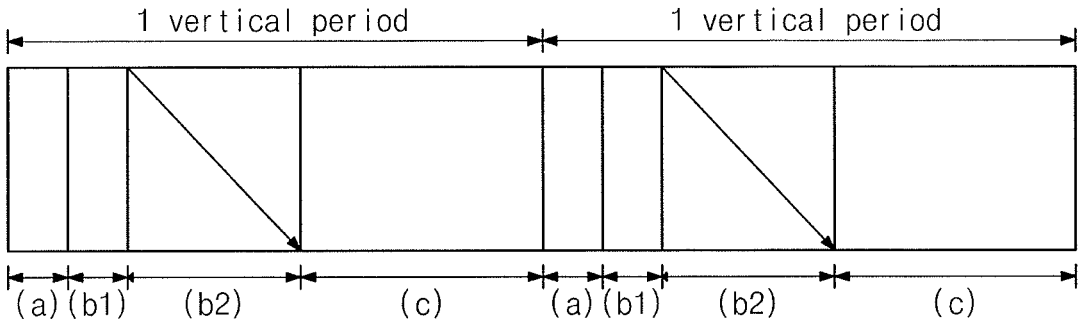
FIG. 12 illustrates a third embodiment of a method for driving a pixel circuit.

FIG. 12 illustrates a third embodiment of a method for driving a pixel circuit, which, for example, may be pixel circuit 100. Referring to FIG. 12, a Vth compensation period (b−1) follows an initialization period (a), and a data program period (b-2) follows the Vth compensation period (b−1). The data program period (b-2) may correspond to the data program period (b) of the first embodiment. Also, initialization period (a) and light emitting period (c) may be the same as in the first embodiment.

Figure 13:
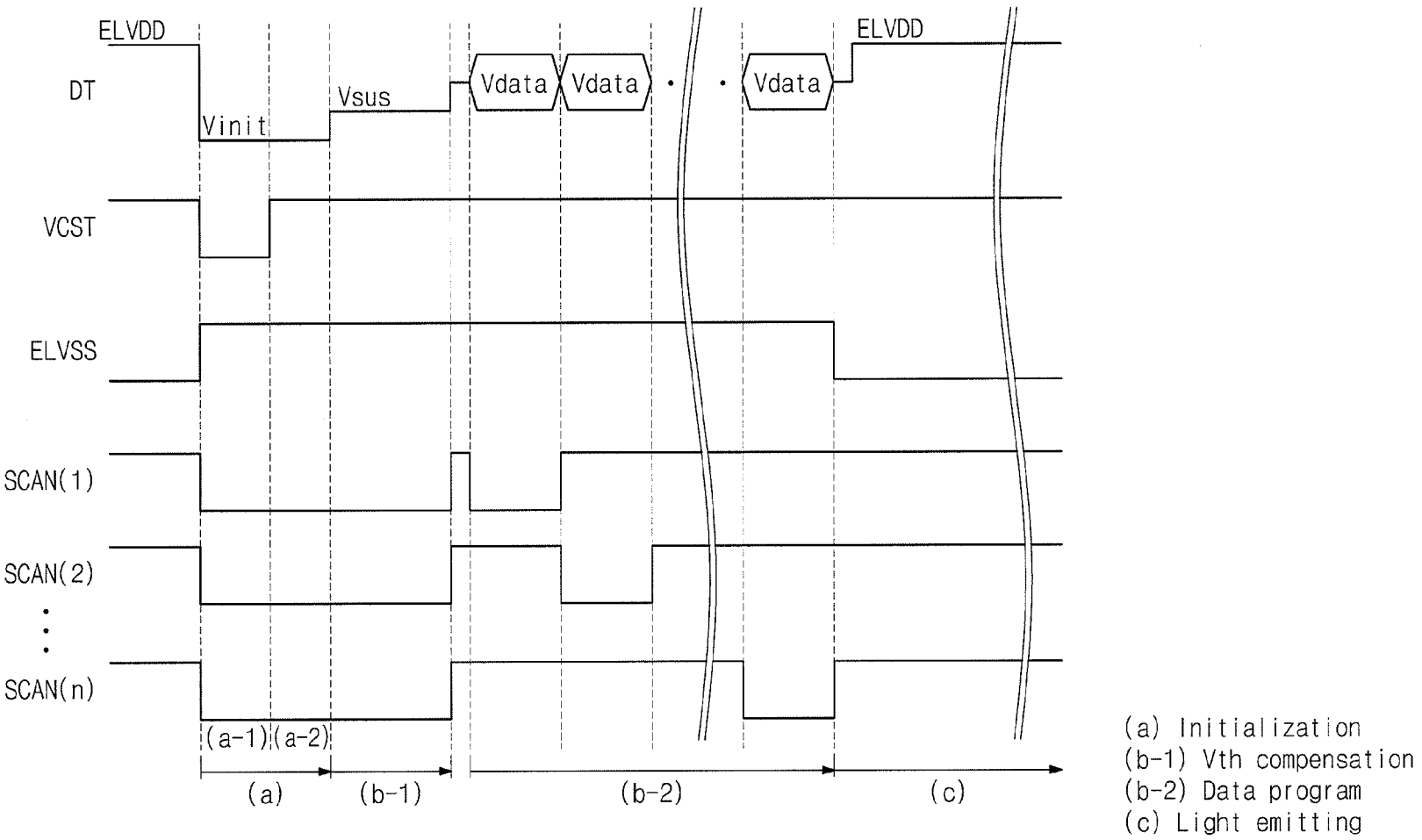
FIG. 13 illustrates a third embodiment of a pixel circuit timing diagram.

FIG. 13 is a third embodiment of a timing diagram illustrating signals for controlling a pixel circuit. Referring to FIG. 13, the third embodiment is different from the first embodiment in that a voltage of data control signal DT is switched to a gray scale data voltage Vdata in a Vth compensation period (b−1). A compensation voltage Vsus is a voltage corresponding to a difference between a gray scale data voltage Vdata and an initialization voltage Vinit. The compensation voltage Vsus may be the lowest voltage (e.g., a voltage closest to the initialization voltage Vinit) that the gray scale data voltage Vdata can have.

Figure 14:
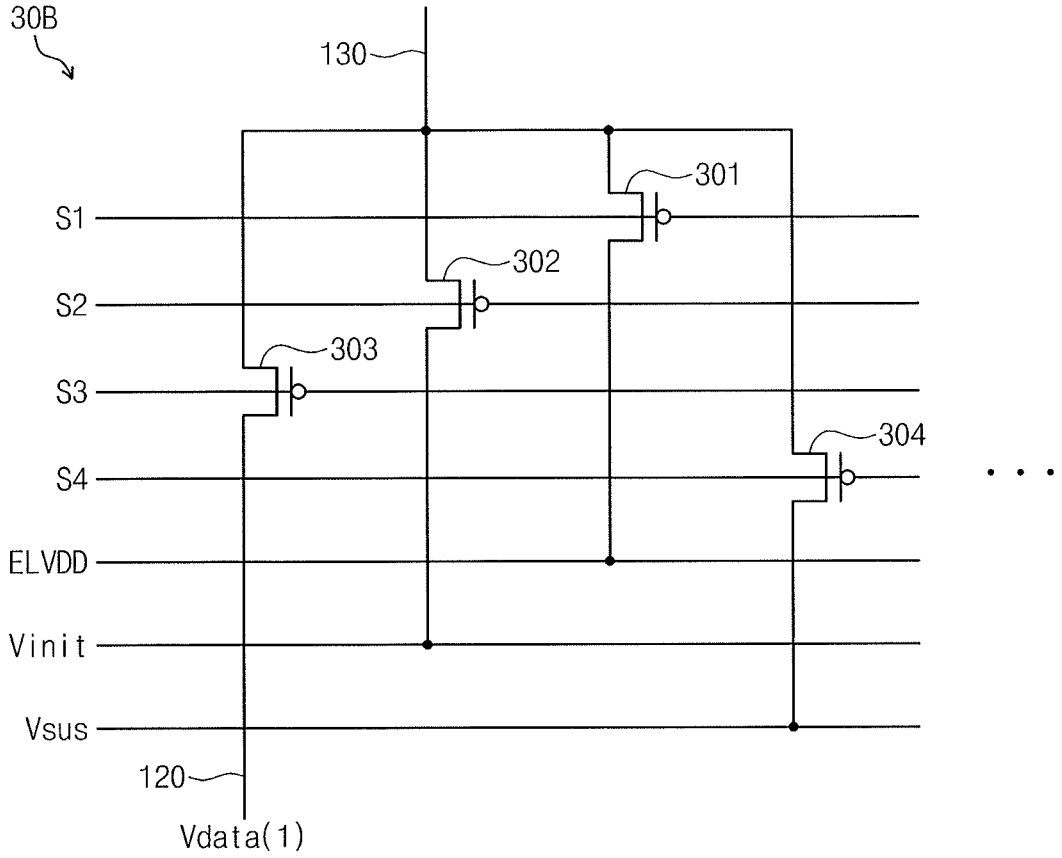
FIG. 14 illustrates another embodiment of a switch circuit.

FIG. 14 is another embodiment of a switch circuit 30B, which may be the same as that used in the first embodiment except that a transistor 304 is included to switch a voltage supplied to data control line 130 to a compensation voltage Vsus. The transistor 304 is turned on or off by a control signal S4.

Figure 15:
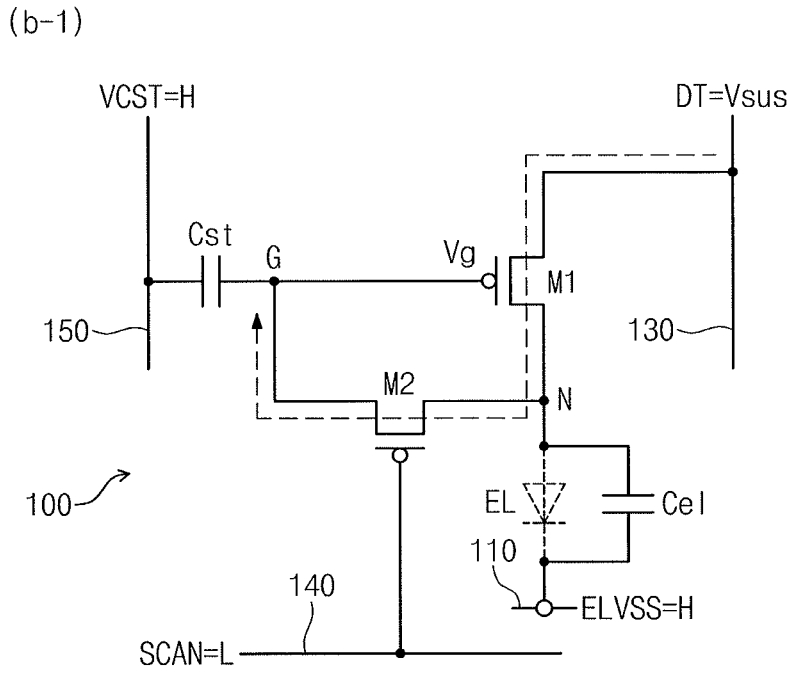
FIG. 15 illustrates another embodiment of driving states of a pixel circuit.

FIG. 15 illustrates another embodiment of a driving state (period (b−1)) of pixel circuit 100. Referring to FIG. 15, when scan signals SCAN of pixel circuits 100 have a low level during a Vth compensation period (b−1), a transistor M2 is turned on. As a result, a gate voltage Vg is set to (Vsus−|Vth|). Afterwards, a data program period (b-2) (corresponding to a data program period (b) of a first embodiment) is executed.

In the first embodiment, threshold voltage compensation for each pixel circuit 100 is performed only during a part of data program period (b), namely the part corresponding to a low level of a scan signal SCAN. Thus, a gate voltage Vg of a data program period may not reach (Vdata−|Vth|) under certain circumstances, e.g., based on variations in the transistor operating characteristics. In this case, the variation in the transistor operating characteristics may be insufficiently compensated.

In contrast, in the third embodiment, a gate voltage Vg after initialization of pixel circuits 100 is previously set to almost a gray scale data voltage Vdata during a Vth compensation period. Thus, although a data program period (b-2) is short, the gate voltage Vg becomes close to (Vdata−|Vth|).

By way of summation and review, in accordance with one or more of the aforementioned embodiments, a display apparatus performs Vth compensation while at the same time reducing the number of transistors per pixel. Thus, a greater layout freedom (e.g., high minuteness, improvement of opening ratio, and the like) may be achieved. Also, uses fewer transistors may be used and product yield may be improved in terms of fabrication.

Also, because a relationship between the anode voltage ELVDD and cathode voltage ELVSS is set such that the light emitting diode EL does not emit a light during the non-light emitting period of the initialization period and the data program period, deterioration of the image quality due to black float is suppressed, and improved high definition may be realized.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display apparatus, comprising:

a first P-type transistor to control an amount of current of a light emitting diode, one of source or drain terminals of the first P-type transistor being connected to an anode of the light emitting diode;

a first control line connected to the other of the source or drain terminals of the first P-type transistor, the first control line to supply a gray scale data voltage to set a gate voltage of the first P-type transistor, an initialization voltage to initialize a gate voltage of the first P-type transistor, and an anode voltage for light emission of the light emitting diode;

a second P-type transistor to selectively connect the one of the source or drain terminals of the first P-type transistor and a gate terminal of the first P-type transistor;

a second control line to supply different levels of voltages; and a capacitive element having a first electrode connected to the gate terminal of the first P-type transistor and a second electrode connected to the second control line.

2. The display apparatus as claimed in claim 1, further comprising:

a control circuit to:

set the light emitting diode to a non-light emitting state by controlling a cathode voltage of the light emitting diode during a non-light emitting period of the light emitting diode, the non-light emitting period including an initialization period of the gate voltage and a data program period following the initialization period, supply the initialization voltage to the first control line and supply a second voltage higher than a first voltage to the second control line after the first voltage is supplied to the second control line during the initialization period, the control circuit turning the second P-type transistor on, supply the gray scale data voltage to the first control line and turn the second P-type transistor on when a gate voltage of the first P-type transistor is set to the gray scale data voltage during the data program period, and turn off the second P-type transistor, control the cathode voltage of the light emitting diode to set the light emitting diode to a light emitting state and control an operation of supplying the anode voltage to the first control line during a light emitting period of the light emitting diode.

3. The display apparatus as claimed in claim 2, wherein:

a compensation voltage between the initialization voltage and the gray scale data voltage is further supplied to the first control line, during a compensation period between the initialization period and the data program period, the control circuit is to turn the second P-type transistor on and is to supply the compensation voltage to the first control line.

4. A display apparatus, comprising:

a first N-type transistor to control an amount of current of a light emitting diode, one of source or drain terminals of the first N-type transistor being connected to a cathode of the light emitting diode;

a first control line connected to the other of the source or drain terminals of the first N-type transistor and to supply a gray scale data voltage to set a gate voltage of the first N-type transistor, an initialization voltage to initialize a gate voltage of the first N-type transistor, and a cathode voltage for light emission of the light emitting diode;

a second N-type transistor to selectively connect the one of the source or drain terminals of the first N-type transistor and a gate terminal of the first N-type transistor;

a second control line to supply two levels of voltages; and a capacitive element having a first electrode connected to the gate terminal of the first N-type transistor and a second electrode connected to the second control line.

5. The display apparatus as claimed in claim 4, further comprising:

a control circuit to:

control the light emitting diode to a non-light emitting state by controlling an anode voltage of the light emitting diode during a non-light emitting period of the light emitting diode, the non-light emitting period including an initialization period of the gate voltage and a data program period following the initialization period, turn the second N-type transistor on, supply the initialization voltage to the first control line, and supply a second voltage higher than a first voltage to the second control line after the first voltage is supplied to the second control line during the initialization period, supply the gray scale data voltage to the first control line and turn the second N-type transistor on when a gate voltage of the first N-type transistor is set to the gray scale data voltage during the data program period, and turn the second N-type transistor off, control the anode voltage of the light emitting diode to set the light emitting diode to a light emitting state, and control an operation of supplying the cathode voltage to the first control line during a light emitting period of the light emitting diode.

6. The display apparatus as claimed in claim 5, wherein:

a compensation voltage between the initialization voltage and the gray scale data voltage is supplied to the first control line, the control circuit turns the second N-type transistor on and supplies the compensation voltage to the first control line during a compensation period between the initialization period and the data program period.

7. A method of driving a display apparatus, the method comprising:

setting a light emitting diode to a non-light emitting state by controlling a cathode voltage of the light emitting diode during a non-light emitting period, the non-light emitting period including an initialization period of a gate voltage of a first transistor and a data program period following the initialization period;

turning on a second P-type transistor during the initialization period, supplying an initialization voltage to a first control line and a second voltage higher than a first voltage to a second control line after the first voltage is supplied to the second control line;

supplying a gray scale voltage to the first control line and turning on the second P-type transistor on when a gate voltage of the first transistor is set to the gray scale voltage during the data program period; and turning off the second P-type transistor and controlling the cathode voltage of the light emitting diode to set the light emitting diode to a light emitting state, and supplying the anode voltage to the first control line during a light emitting period.

8. The method as claimed in claim 7, further comprising:

supplying a compensation voltage to the first control line, the compensation voltage being between the initialization and gray scale data voltage, and turning on the second P-type transistor and supplying the compensation voltage to the first control line during a compensation period between the initialization period and the data program period.

9. A method of driving a display apparatus, the method comprising:

setting a light emitting diode to a non-light emitting state by controlling the anode voltage of the light emitting diode during a non-light emitting period, the non-light emitting period including an initialization period of a gate voltage of a first transistor and a data program period following the initialization period;

turning on a second transistor, supplying an initialization voltage to a first control line, and supplying a second voltage higher than a first voltage to a second control line after the first voltage is supplied to the second control line during the initialization period;

supplying a gray scale voltage to the first control line and turning on the second transistor when a gate voltage of the first transistor is set to the gray scale voltage during the data program period; and turning off the second transistor, controlling the anode voltage of the light emitting diode to set the light emitting diode to a light emitting state, and supplying the cathode voltage to the first control line during a light emitting period.

10. The method as claimed in claim 9, further comprising:

supplying a compensation voltage to the first control line, the compensation voltage being between the initialization and gray scale data voltages, and turning on the second transistor and supplying the compensation voltage to the first control line during a compensation period between the initialization period and the data program period.

11. An apparatus, comprising:

a pixel circuit;

a driving transistor in the pixel circuit; and a signal line connected to a source or drain of the driving transistor, wherein the source or drain of the driving transistor receives a power source voltage, an initialization voltage, and a data voltage through the signal line during different periods of operation.

12. The apparatus as claimed in claim 11, wherein:

the initialization voltage and data voltage are received through the signal line during non-light-emission periods, and the power source voltage is received during a light-emission period.

13. The apparatus as claimed in claim 11, further comprising:

a switching transistor coupled to a gate of the driving transistor, wherein the switching transistor is to place the driving transistor in a diode-connected state during a non-light-emission period based on a scan signal.

14. The apparatus as claimed in claim 13, wherein the driving transistor and the switching transistor are the only transistors in the pixel circuit.

15. The apparatus as claimed in claim 13, further comprising:

a capacitor connected to the gate of the driving transistor, wherein the switching transistor is connected to the gate of the driving transistor at a location between the gate of the driving transistor and the capacitor.

16. The apparatus as claimed in claim 15, wherein the capacitor receives the data voltage along a data path which passes through the driving transistor and the switching transistor.

17. The apparatus as claimed in claim 11, wherein the source or drain of the driving transistor receives a compensation voltage through the signal line during a compensation period.

18. The apparatus as claimed in claim 17, wherein the compensation voltage is between the power source voltage and the initialization voltage.

19. The apparatus as claimed in claim 18, wherein the compensation voltage is less than the data voltage.

20. The apparatus as claimed in claim 17, wherein the compensation period is between an initialization period and a data program period of non-light-emission period.

* * * * *